US007785026B2

(12) United States Patent
Eng et al.

(10) Patent No.: US 7,785,026 B2
(45) Date of Patent: Aug. 31, 2010

(54) COSMETIC APPLICATOR DEVICE

(76) Inventors: Serena Eng, 18 Heather La., Warren, NJ (US) 07059; Charles Chang, 55 Westview Rd., Wayne, NJ (US) 07470

( * ) Notice: Subject to any disclaimer, the term of this patent is extended or adjusted under 35 U.S.C. 154(b) by 906 days.

(21) Appl. No.: 11/650,889

(22) Filed: Jan. 8, 2007

(65) Prior Publication Data

US 2008/0166172 A1 Jul. 10, 2008

(51) Int. Cl.
*A47L 13/26* (2006.01)

(52) U.S. Cl. ..... 401/37; 401/25; 401/263; 401/266

(58) Field of Classification Search ..... 401/6, 401/9, 25, 26, 37, 39, 171, 172, 174, 175, 401/263, 265, 266
See application file for complete search history.

(56) References Cited

U.S. PATENT DOCUMENTS

| | | | | |
|---|---|---|---|---|
| 2,336,328 | A * | 12/1943 | Whalen | 401/11 |
| 2,442,503 | A * | 6/1948 | Melnikoff | 132/320 |
| 4,887,924 | A | 12/1989 | Green | |
| 5,524,764 | A | 6/1996 | Kaufman et al. | |
| D414,688 | S | 10/1999 | Loeb et al. | |
| D423,355 | S | 4/2000 | Loeb et al. | |
| 6,050,274 | A | 4/2000 | Gelardi et al. | |
| 6,325,783 | B1 | 12/2001 | Laughlin et al. | |
| 6,371,673 | B1 * | 4/2002 | Gueret | 401/31 |
| 6,414,032 | B1 | 7/2002 | Johnson | |
| 6,607,323 | B2 | 8/2003 | Breidenbach et al. | |
| 6,745,781 | B2 * | 6/2004 | Gueret | 132/320 |
| 6,746,170 | B2 * | 6/2004 | Delage | 401/266 |
| 2004/0165935 | A1 | 8/2004 | Kaufmann et al. | |
| 2005/0047848 | A1 | 3/2005 | Carraher | |

* cited by examiner

*Primary Examiner*—David J Walczak
(74) *Attorney, Agent, or Firm*—Levisohn Berger LLP

(57) ABSTRACT

A cosmetic stick applicator for treating the lips of a person. The applicator has an elongate, tubular body with an inner chamber for storing a chemical formulation or substance such as an exfoliant, to be applied to the lips. One end of the body has an external, oblique, lip-engageable abrasive applicator surface containing a product-dispensing orifice through which the substance can be ejected. Such ejection is accomplished by means of a finger-engageable wheel that is turned to forcibly discharge the substance through the orifices and onto the applicator surface. Thereafter this surface which now contains the discharged substance, is rubbed against the lips and thus effects a scrubbing thereof, which brings about gentle and controlled exfoliation of accumulated dead skin cells. Following this, excess dead cell material can be wiped off with a tissue or pad.

12 Claims, 7 Drawing Sheets

COSMETIC APPLICATOR DEVICE

STATEMENT AS TO RIGHTS TO INVENTIONS MADE UNDER FEDERALLY SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates generally to cosmetic products for the face, and more particularly to means and methods for treating the lips in order to produce a known, beneficial result.

2. Description of the Related Art Including Information disclosed under 37 CFR 1.97-1.99

The following patents are hereby made of record and are believed to constitute a sampling of existing prior art in the field to which the present invention relates:

U.S. Pat. Nos.: 4,887,924
6,050,274
6,607,323
6,414,032
6,325,783
5,524,764
U.S. Design Pats. Nos.: D414,688
D423,355
U.S. Published Patent Applications Nos. 2004/0165935

U.S. Patent Publication No. 2005/0047848 illustrates a prior art dispenser tube which incorporates allegedly improved features claimed by its inventor. Specifically, in FIG. 1 of the patent, there is shown a crimped-end squeeze tube having a slanted applicator surface at one end, and having a product-dispensing hole in this end. The device shown in FIGS. 2-4 has a concave or hollowed end surface, purportedly to facilitate return of excess dispensed substance back into the tube, following use. Paragraph 0005 makes specific reference to use of tubes of the type disclosed, where a quantity of an emollient is to be applied to a user's lips, as an example.

FIG. 2D of U.S. Pat. No. 6,414,032 shows the use of an applicator brush for use on the lips, the brush having a characteristic of being abrasive. Col. 7, line 22, specifies " . . . the applicator is preferably configured to provide a relatively uniform abrasive action." Col. 12, lines 51-53 further specify, "Note however that small amounts of inert abrasive material may be present in the treatment compositions as discussed hereinbelow." Col. 17, line 27; and col. 21, line 7 also address the use of abrasives.

In U.S. Pat. No. 6,050,724, there are disclosed multiple embodiments of dispensers for applying substances to the lips. The lip-engaging surfaces in FIG. 5 of the patent are convex, and arranged to accommodate a ring-shaped bead of the dispenser contents onto such surfaces.

U.S. Pat. No. 6,607,323 shows yet another applicator for the lips. Specifically, in FIGS. 3 and 4, there is disclosed an applicator stick having an angled applicator surface thereon. The surface has a generally tear-drop shape, and is slightly convex in its configuration. Col. 7, lines 29 onward.

Still another dispenser for applying substances to the lips is disclosed in U.S. Pat. No. 4,887,924. In particular, the dispenser is in the form of a squeeze tube having a convex, angled lip-engaging surface containing a hole off to one side of its center. In the well known manner, the product in the tube is expelled by controlled squeezing of the container or storage portion thereof.

U.S. Published patent application No. 2004/0165935 shows a number of different applicator devices generally designed for containing two different liquids that are separated during shipping and storage, and which are automatically mixed by the user when he wishes to begin applying the mixture of the liquids to the skin, hair, fingernails or toe-nails. The disclosure is non-specific as to the liquids involved, as can be seen from page 6, paragraphs 0119-0123.

Further, U.S. Pat. No. 6,325,783 relates to a method of chemically bleaching skin and/or discolored nails. In the case where an exfoliant is utilized, the patent Abstract mentions the use of fine abrasive particles such as ground walnut shells, pumice, or sand.

In addition, U.S. Pat. No. 5,524,764 discloses a cloth or sheath that is treated with an absorbent material and an abrasive. The sheath is utilized by holding the sheath in the hand and wiping the desired area, be it the teeth, tongue, gums or lips of the consumer.

U.S. Design Pat. Nos. 414,688 and 423,355 relate to applicator tube configurations, but without specific reference to substances with which the respective tubes are to be utilized.

SUMMARY OF THE INVENTION

At present it is believed that many of the prior art devices noted above have not achieved widespread use, or enjoyed a significant degree of success or commercialization in the marketplace.

Possible reasons for this are thought to be the relative complexity of a particular construction or arrangement, inadequate promotion or marketing, and/or insufficient financing leading to a production run. At any rate, there has existed a need for an extremely compact, multi-use applicator stick for the lips, in particular one that can be used repeatedly, one which lends itself to a dual function, namely both exfoliation and buffing of the lips, and one that is incorporated into a single, portable, cosmetic article.

Accordingly it is one object of the invention to provide an improved cosmetic applicator stick for treatment of the lips, which applicator stick is both simple in its structure, and reliable in use.

A related object is to provide an improved applicator stick as above noted, wherein a simple twist-movement of an actuator wheel on an applicator casing effects a corresponding controlled discharge of a cosmetic substance contained in the casing.

Still another object of the invention is to provide an improved cosmetic stick applicator as above characterized, wherein a dual function is achieved in a single applicator casing by virtue of the latter having lip-treatment surfaces on its opposite ends. There is thus eliminated the need for multiple treatment devices for accomplishing different, desired functional results in the treatment of the lips of the user.

These and other objects of the invention are accomplished, in one embodiment, by the provision of a cosmetic applicator stick for effecting treatment of the lips of a person, comprising in combination an elongate, tubular body having an inner chamber for storing a substance to be dispensed onto the lips, and having opposite ends which function to provide different treatment effects. In particular, one end comprises an oblique lip-engageable applicator surface connected with the body, and wherein the surface includes one or more product-dispensing orifices through which the substance can be dispensed. There are provided manually-engageable means on the body, operable by the fingers of the person, for effecting controlled discharge of the substance. The latter is propelled from the inner chamber out through the product-dispensing orifice or orifices, and onto the applicator surface, thereby enabling such surface and substance thereupon to be utilized to gently scrub the lips and effect controlled exfoliation thereof. The applicator surface preferably has been treated with electrostatically-applied or mechanically applied flock fibers, thus creating a flock, sometimes referred to as a flocked surface. At the other end of the body there is a second oblique applicator surface integral with the remainder of the body, the second oblique applicator surface having a textured configuration to produce on the lips, a result that is distinct from that of the action of the first mentioned surface. The arrangement is such that following application of the substance from the one end to the lips, the body can be reversed and the second applicator surface utilized to polish the lips and thus impart a smoothing effect thereto.

The advantage of the present invention is that both a moderately coarse scrubbing and a gentler, buffing and/or polishing action are capable of being achieved by the use of the single applicator instrument. And, as noted above, the applicator stick is especially compact and easy to access and use.

BRIEF DESCRIPTION OF THE DRAWINGS

In the accompanying drawings, illustrating several embodiments of the invention.

DESCRIPTION OF THE PREFERRED EMBODIMENTS

Figure 1:
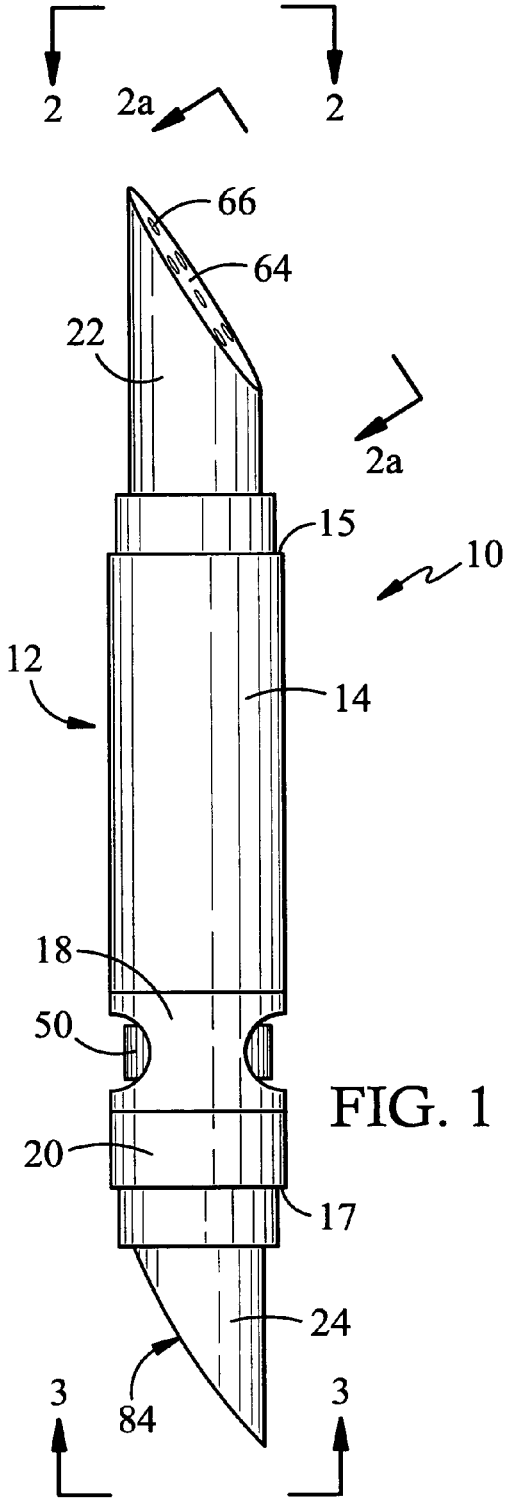
FIG. 1 is an enlarged side elevational view of the improved cosmetic stick applicator of the present invention.
Figure 2:
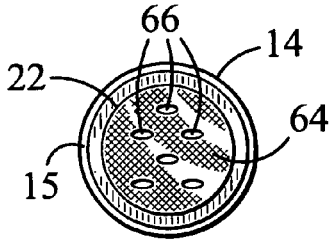
FIG. 2 is an enlarged top plan view of the cosmetic stick applicator of FIG. 1.
Figure 2A:
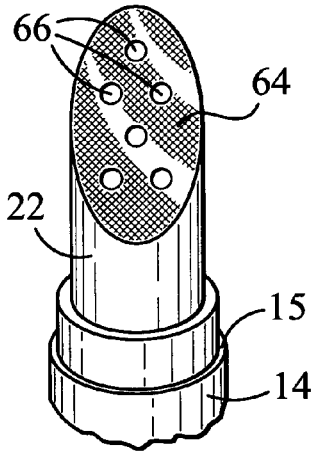
FIG. 2*a* is a view taken on the line 2*a*-2*a* of FIG. 1.
Figure 3:
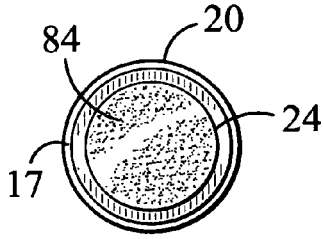
FIG. 3 is an enlarged bottom plan view of the cosmetic stick applicator of FIGS. 1 and 2.
Figure 4:
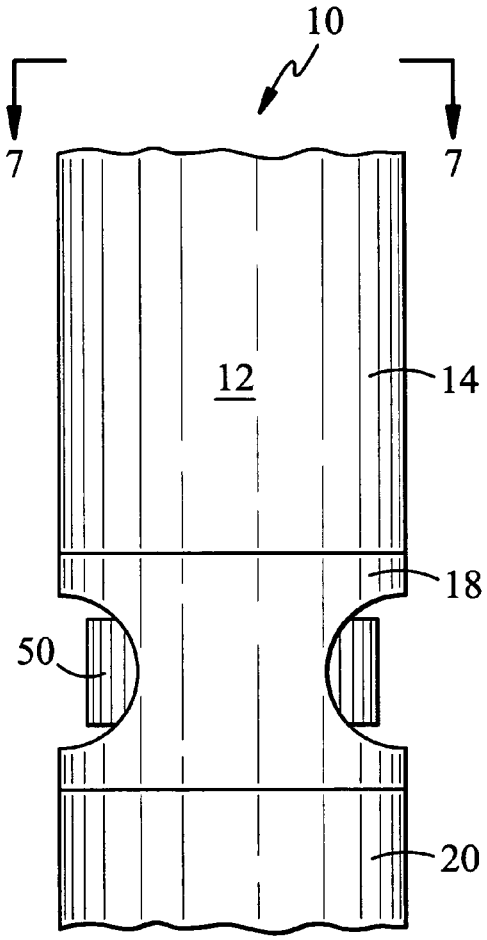
FIG. 4 is an enlarged, fragmentary side elevational view of the cosmetic stick applicator of FIGS. 1-3.
Figure 5:
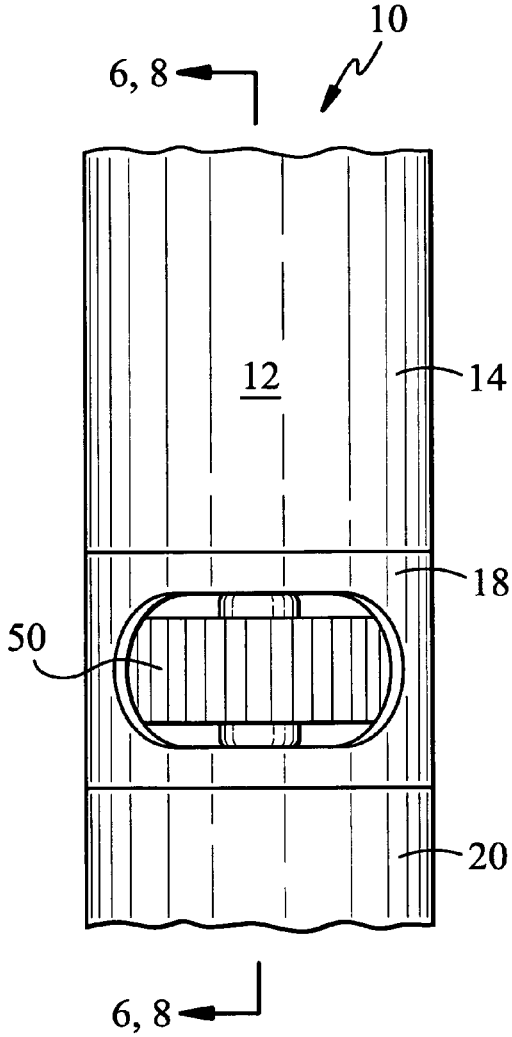
FIG. 5 is an enlarged, fragmentary side elevational view of the cosmetic stick applicator of FIGS. 1-4, shown rotated 90 degrees from the position of FIG. 4.
Figure 7:
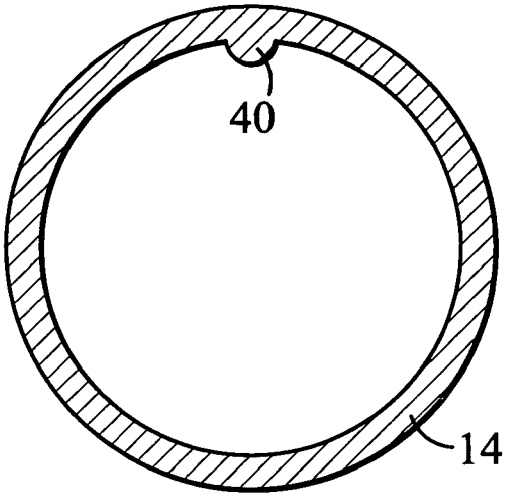
FIG. 7 is a horizontal section through one of the annular sections of the cosmetic stick applicator that are used to form the casing wall.

Referring first to FIGS. 1-8 and in accordance with the present invention there is illustrated a novel and improved cosmetic stick applicator device 10 for use in cleansing and effecting ameliorative treatment of the lips of a person, and for enhancing the lips' overall appearance. In accomplishing the objectives of the invention, the applicator device is provided with a unique double-ended lip-treatment surface configuration which enables the user to first effect an initial exfoliation of the lips by use of one end of the stick applicator device, and thereafter in a separate step and using the same device, to bring about a buffing or polishing of the lips so as to impart to them a smooth texture that can be left as is, or alternately have lip balm/lipstick applied thereto. By incorporating but a single casing for the device, there is simplified the treatment of the lips for both the exfoliation step and the subsequent polishing step.

In FIGS. 1-6, the device is seen to comprise an essentially tubular body portion generally designated by the numeral 12, and being constituted of annular sections 14, 18 and 20, respectively, defining a chamber or cylinder 16, together with a pair of end caps 22 and 24, which are fitted to adjacent annular sections 14 and 20 respectively, by means of a telescoping fit. The end caps 22, 24 can be secured by suitable adhesive that is compatible with the plastic utilized in the sections 14, 20, or by means of ultrasonic welding or other methods known in the plastics art.

Figure 9:
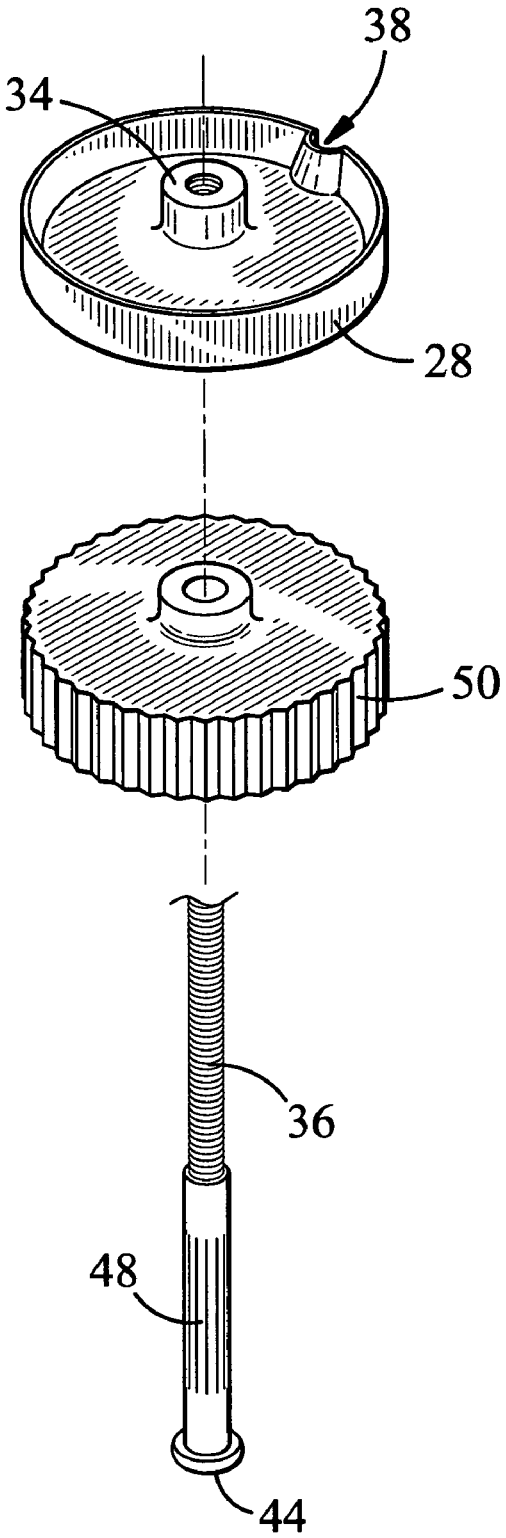
FIG. 9 is an exploded view of a threaded rod as utilized in the propeller mechanism of the stick applicator of FIGS. 1-8.

Referring again to FIG. 6, there is received in the tubular annular section 14 a reciprocatable piston 28 having a generally circular peripheral sealing wall 30, and a transverse bottom wall. Disposed at the center of the piston 28 is an internally threaded boss 34 which cooperates with a correspondingly threaded rod 36 which is aligned with the centerline of the annular section 14. There is a bearing for the bottom of the threaded rod 36 which will be discussed further below. The piston 28 has a peripheral notch 38 (FIG. 9) at one point in its circumference, which is adapted to slidably receive an internal axially-disposed keying rib 40 (FIG. 7) on the annular section 14. The arrangement is such that the engagement of the rib 40 with the walls of the notch 38 prevents relative turning of the piston 28 with respect to the casing section 14.

Referring again to FIG. 6, the applicator casing has a transverse wall 32 in its annular section 20, and as described further below, a bearing is provided on the wall 32, to receive the threaded rod 36. The bottom of the rod 36 has an integrally formed flat 44, which fits against a molded extension or boss 45 on the transverse wall 32. There is preferably formed integral with the threaded rod 36, a knurled section 48, to which there is press-fitted a manually engageable means comprising a knurled finger-engageable drive wheel 50. As shown, the tubular portion of the annular section 18 of the casing has side windows or access cutouts 52, 54, disposed 180 degrees opposite one another, to enable access to the drive wheel periphery by the fingers of the user.

The drive wheel 50 further has a depending projection 56 at its center which bears against the upper surface of the transverse wall 32. The boss 45, the projection 56 and adjacent portions of the transverse wall 32 thus constitute a positioning bearing for the lower portion of the threaded rod 36. The upper portion of the rod 36 is maintained centralized by the piston 28 regardless of the particular axial position occupied by the latter. With the disclosed arrangement, by turning the wheel 50 by the fingers of the user and in the direction indicated by the curved arrow 58 in FIG. 6, the threaded rod 36 will impart axially upward movement to the piston 28, and incrementally move the latter upwardly inside the chamber 16, as indicated by the two wide arrows 60, 62 in this figure.

Figure 6:
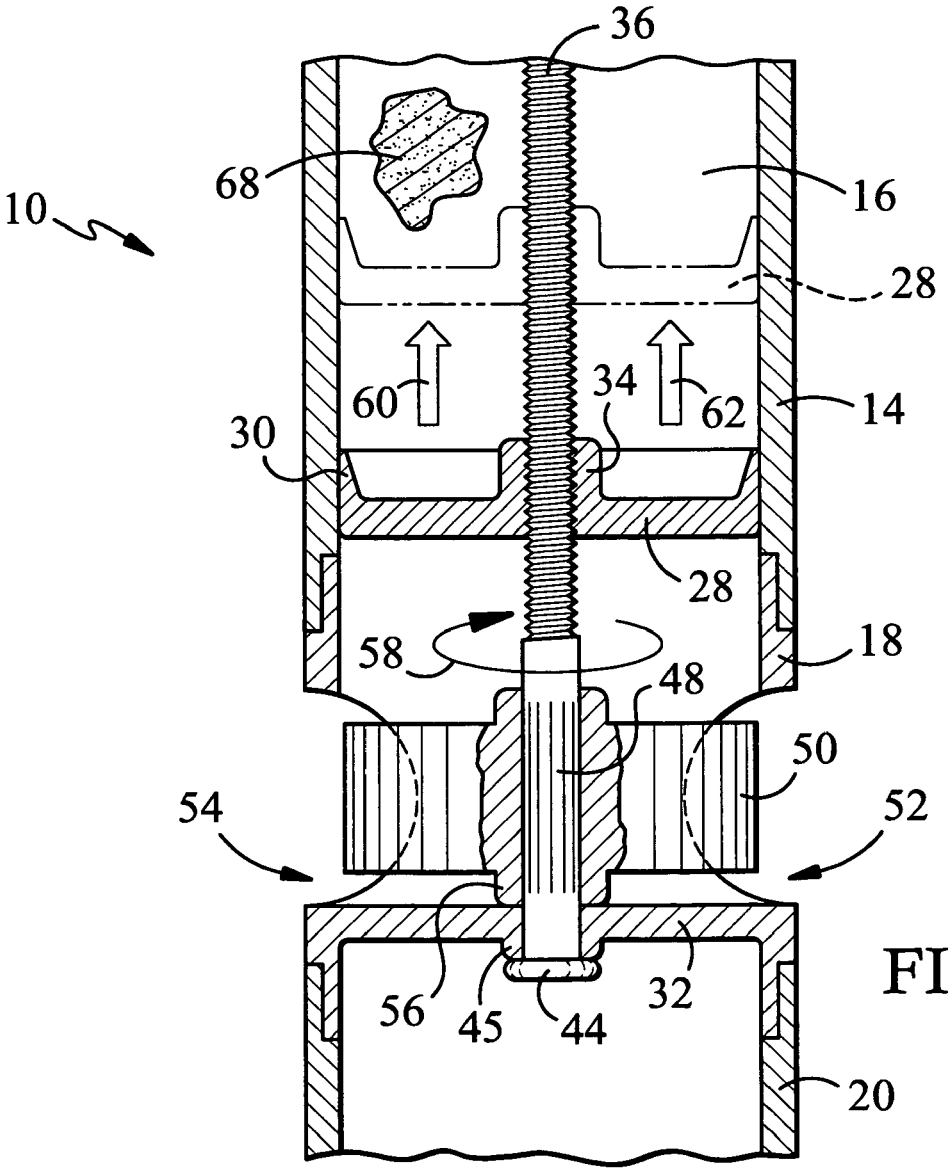
FIG. 6 is an enlarged fragmentary side elevational view of the cosmetic stick applicator of FIGS. 1-5, particularly showing inner details thereof, and illustrating an inner chamber of the applicator casing partially filled with a water-based cosmetic material.

Referring again to FIG. 2, by the invention the upper end cap 22 on the body portion 12 is provided with an oblique lip-engaging surface 64 that is slanted as shown, and has a series of small product-dispensing holes 66 which extend completely through the top wall of the cap 22 and communicate with the chamber 16. The invention further provides for a flocking or flocked surface thereon. A therapeutic substance 68, FIG. 6, is provided, which can be a fluid or paste comprising an ameliorative material selected from the group consisting of liquid-based, oil-based, and wax-based substances. The combination of the flocked surface and the substance 68 is of a type intended to enable gentle exfoliation of the lips of the user as the surface is applied thereto and reciprocated slowly back and forth thereagainst. In the preferred embodiment, the liquid includes an abrasive component held in suspension, the component being in the form of plastic or rubber particles having a size commensurate with that of cane sugar crystals of the type commonly provided in consumer supermarkets. Typically, the diameter of these particles is on the order of two- to four-hundred micrometers, but different sizes can be readily incorporated in the liquid as it is being prepared, and loaded into the chamber 16 (the step of loading the liquid into the chamber is not illustrated in the figures). FIG. 6 specifically shows the chamber 16 as containing a quantity of water-based cosmetic material 68, whereas FIG. 8 illustrates the same chamber 16 as having a quantity of oil- or wax-based cosmetic material 80.

Figure 8:
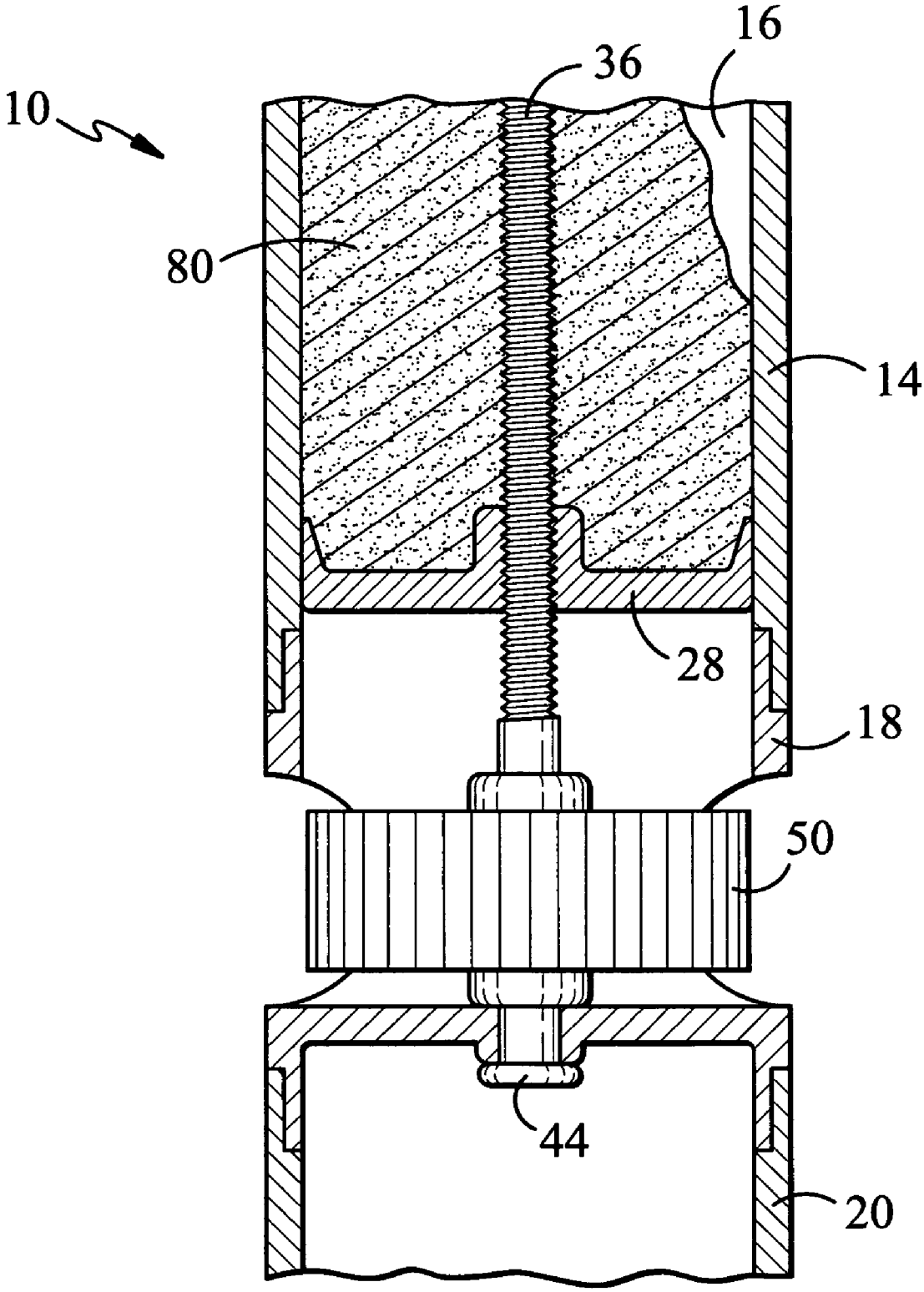
FIG. 8 is a view similar to FIG. 6, except showing the inner chamber of the applicator casing as being partially filled with an oil- or wax-based cosmetic material.

Further by the invention, in use, the drive wheel 50 is slowly turned by the user, to force the piston upwardly in FIG. 6 or 8, which propels hydraulically a small, controlled quantity of the material 68 or 80 contained in the chamber 16. As noted above, by the invention this material contains a desired amount of abrasive, which is thus transferred onto the flocking or flocked surface 64 that is on top of the underlying plastic of the cap 22. In particular, the term flocking involves the application of fine particles to adhesive coated surfaces. The majority of flocking is done using finely cut natural or synthetic fibers. Flocked finishes impart a decorative and/or functional characteristic to the surface. Flock fibers are usually applied to adhesive coated surfaces mechanically, electrostatically, or by a combination of both techniques. Flocking can impart, to a surface, a functional characteristic, as for example friction modification, insulation, liquid retention or dispersal, buffing or polishing, and/or cushioning and protection. In the present invention, the function of liquid dispersal is utilized. Often, the surface having the flocking applied to it is referred to as a 'flocked surface'. Two types of flocking can be utilized in connection with the present invention: Mechanical flocking and electrostatic flocking.

This feature of providing a flock or flocked texture 64 is believed to significantly enhance the exfoliation function of the stick applicator, thereby creating a treatment similar to what we consider to be a scrubbing characteristic. By so incorporating the flock on the surface, it is considered that this gentle scrubbing action can be readily achieved by the user, very safely and without removal of excess skin, which of course would be detrimental. Such exfoliation of the lip surface is believed to be beneficial from the standpoint of subtle removal of unwanted dead cells, in a controlled and beneficial manner.

It is to be noted that flocking on the surface is so arranged to be clear of any of the dispensing orifices, as can be readily understood, to enable unobstructed flow of the substance from the chamber onto the surface.

Further by the invention the opposite surface 84 of the applicator stick is provided with a finer, textured tone, similar to that of pumice or fine sandpaper. This surface is adapted to be placed against the lips and reciprocated slowly. The net effect is to smooth or polish the lips, and this can be done following treatment of the lips by the flocked end, or as needed by the particular user.

Figure 15:
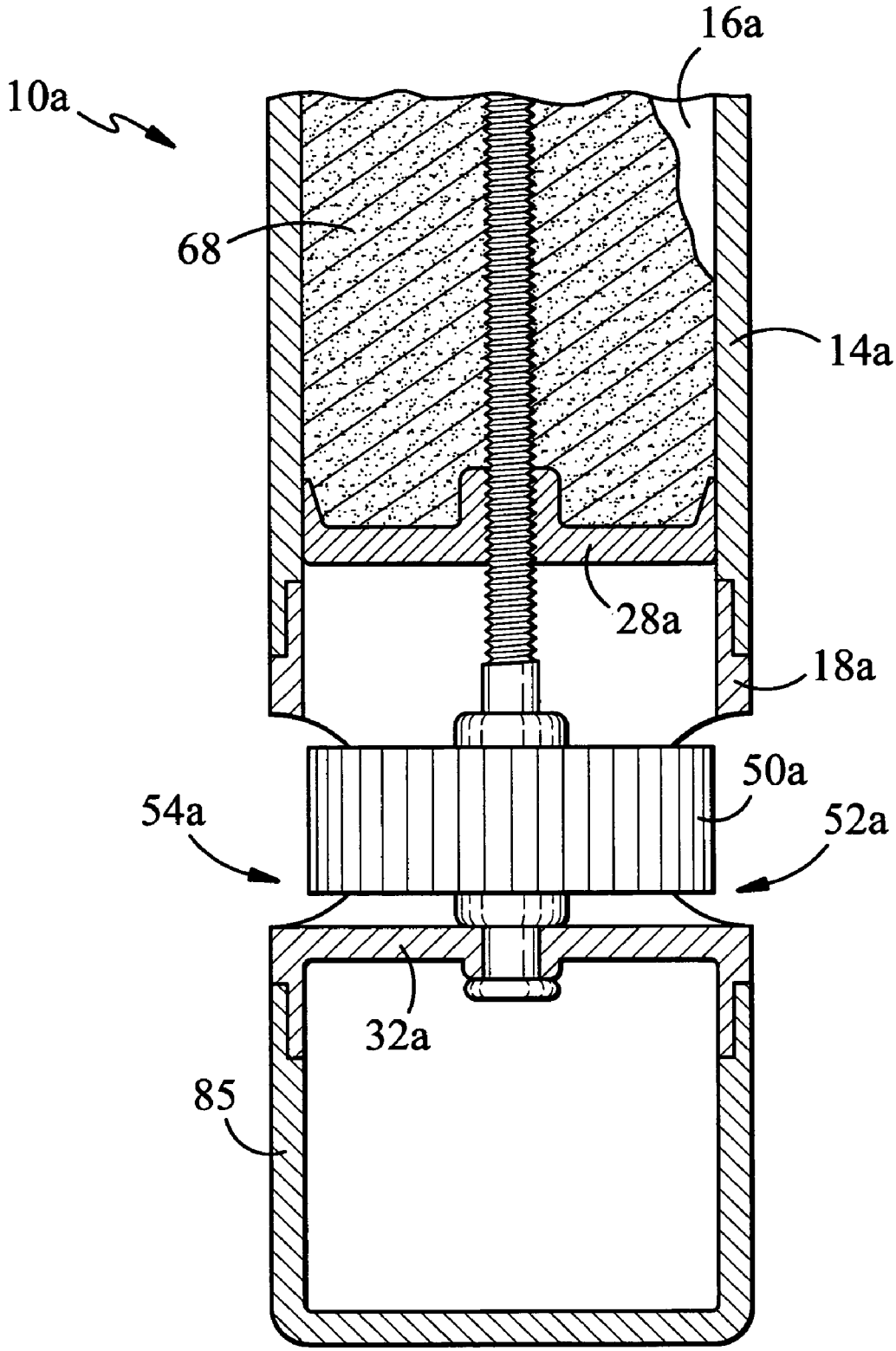
FIG. 15 is a view like FIG. 6, showing inner details of the modified cosmetic stick applicator of FIG. 12.

Another embodiment of the invention is illustrated in FIGS. 12-15, showing a modified cosmetic stick applicator generally designated by the numeral 10*a*, and like reference numerals have been applied to components corresponding the embodiment of FIGS. 1-11, with the suffix "a" appended thereto. The modification comprises a tubular body portion and consisting of multiple annular sections 14*a* and 18*a*, the sections 14*a* and 18*a* defining a chamber 16*a* as in the previous construction. In FIG. 15, there are illustrated a piston 28*a* functioning as in the previous embodiment, and the annular section 18*a* has a transverse bottom wall 32*a*. Access to the drive wheel 50*a* is by means of the windows 52*a* and 54*a*.

Referring to FIGS. 12-15 and in accordance with the invention there is provided an upper end cap 22*a* having a textured lip-engaging surface 64*a* with a series of product-discharge holes 66*a* therein which communicate with the chamber 16*a*. The bottom section of the embodiment of FIGS. 12-15 is merely in the form of a flush end plug 85 that serves as a base for the applicator stick.

Referring to FIGS. 12-15 and further in accordance with the invention, the chamber 16*a* is filled with a cosmetic substance 68 that is either water-based or wax- or oil based, and which further contains a slightly abrasive material. The combination of the particles in the substance and the textured lip-engaging surface 64*a*, provides a polishing or buffing characteristic. The texture 84 of the surface 64*a* is similar to that of fine sandpaper, and can be incorporated in the plastic itself.

Figure 10:
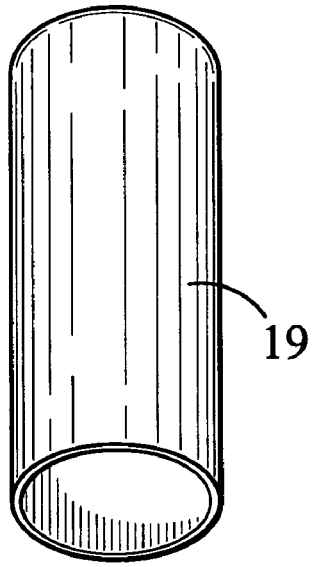
FIG. 10 is a perspective view of a protective cover or closure cap adapted to be received on the upper end of the cosmetic stick applicator of the invention.
Figure 11:
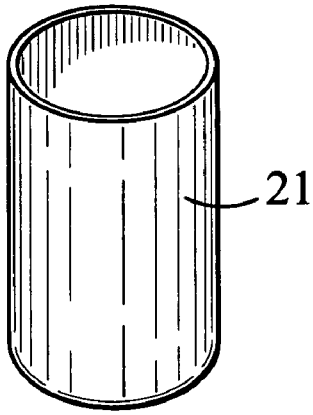
FIG. 11 is a perspective view of a second protective cover or closure cap adapted to be received on the lower end of the cosmetic stick applicator of the invention.
Figure 12:
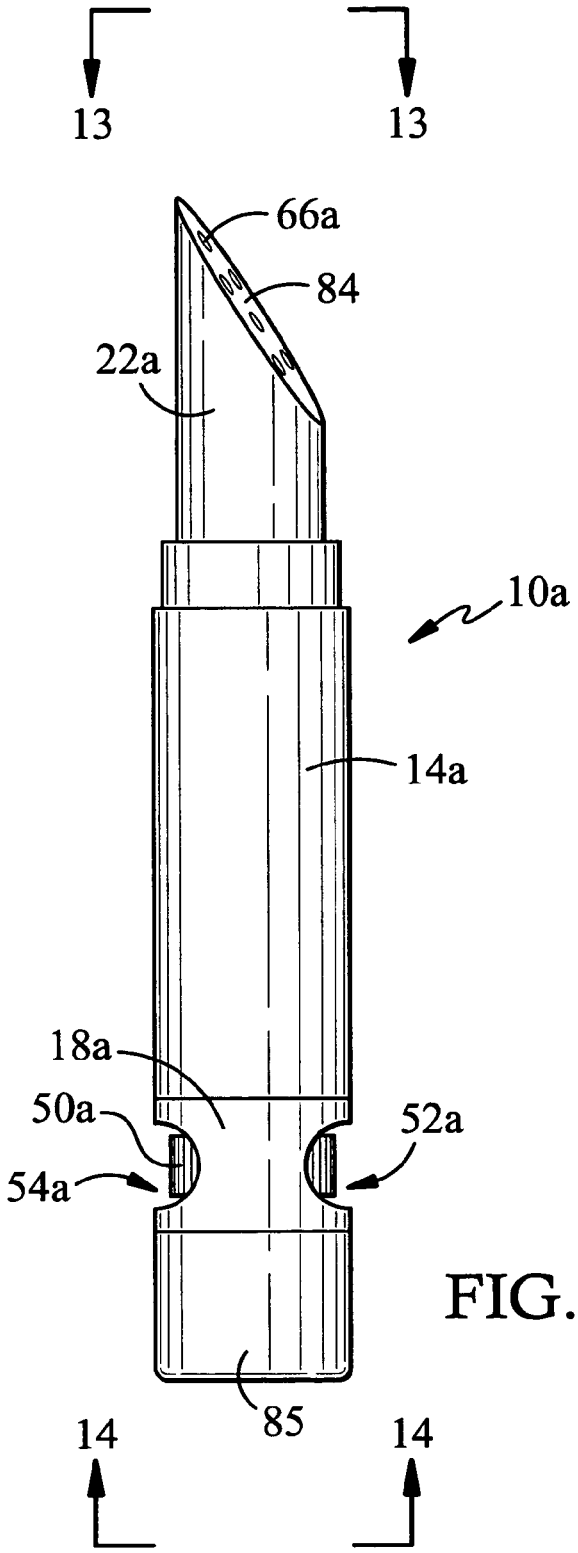
FIG. 12 is a side elevational view of a modified cosmetic stick applicator, featuring a single, apertured lip-engaging surface.
Figure 13:
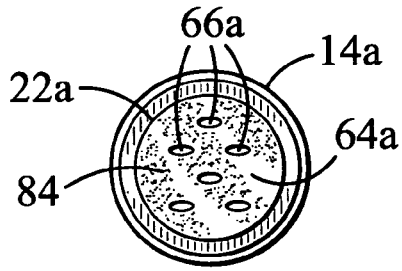
FIG. 13 is a top plan view of the modified cosmetic stick applicator of FIG. 12.
Figure 14:
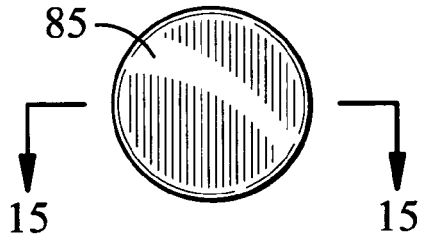
FIG. 14 is a bottom plan view of the modified cosmetic stick applicator of FIGS. 12 and 13.

As an option, in the first embodiment, FIG. 1, the annular sections 14 and 20 may preferably be provided with annular shoulders 15 and 17 respectively, adapted to receive closures or dust covers 19 and 21, shown particularly in FIGS. 10 and 11. These may take the form of simple caps of a dimension to rest upon the respective shelf 15, 17, as can be readily understood. This would tend to reduce the possibility of contamination of the flocked lip engaging surface 67 or the buffing surface 84, as when the device is being carried in a pocketbook or purse.

In use, referring again to FIGS. 12-15, the wheel 50*a* is turned fractionally to expel a small quantity of the substance 68 out through the holes 66*a*, and thereafter the lip-engaging surface 64*a* rubbed across the lips gently, until the desired buffing or polishing effect is achieved.

In practice, choice of which stick applicator to use would depend on whether exfoliation was required first, and/or whether buffing of the lips was to be preferred.

In other respects the second embodiment is similar in operation to that of the first.

From the above it can be seen that we have provided a novel and improved cosmetic applicator construction which is both simple in its operation, tidy in use, and which is readily capable of being stored in the pocketbook or purse of the consumer. The device is thus seen to represent a distinct advance and improvement in the field of cosmetic applications.

Each and every one of the appended claims defines an aspect of the invention which is separate and distinct from all others, and accordingly it is intended that each claim be treated as such in any determination of novelty or validity.

Variations and modifications are possible without departing from the spirit of the invention, and certain portions of the improvement can be utilized without other portions.

LIST OF REFERENCE NUMERALS

10, 10*a* Cosmetic stick applicator device
12 Tubular body portion
14, 14*a* Annular section
15 Annular shoulder
16, 16*a* Chamber or cylinder
17 Annular shoulder
18, 18*a* Annular section
19 Dust cover
21 Dust, cover
20 Annular section
22, 22*a* End cap
24 End cap
28, 28*a* Piston
30 Piston sealing wall
32, 32*a* Transverse bottom wall
34 Threaded boss
36 Threaded rod
38 Peripheral Notch
40 Keying rib
42 Transverse wall
44 Flat on rod
45 Molded boss
48 Knurled section
50, 50*a* Drive wheel
52, 52*a* Access window
54, 54*a* Access window
56 Depending projection
58 Arrow
60 Wide arrow
62 Wide arrow
64, 64*a* Lip-engaging surface
66, 66*a* Product dispensing hole
67 Flocking
68 Water-based cosmetic material
80 Oil- or wax-based cosmetic material or substance
84 Buffering/polishing surface texture on lip-engaging surface
85 Bottom cap

The invention claimed is:

1. A cosmetic stick applicator for effecting treatment of the lips of a person, comprising in combination:

a) a tubular body having an inner chamber, a substance to be dispensed onto the lips, said substance to be dispensed onto the lips stored in said inner chamber, b) said body being elongate, and having oppositely disposed ends, said one end comprising a first obliquely-disposed lip-engageable applicator surface connected with said body, c) said first applicator surface having a product-dispensing orifice through which said substance can pass, and d) manually-engageable means on said tubular body and being operable by the fingers of the person, for effecting forcible discharge of said substance, from said inner chamber and out through said product-dispensing orifice, and onto said first applicator surface, thereby enabling the said first surface and discharged substance to be utilized to scrub the lips and effect controlled exfoliation thereof, e) said body having at its end which is opposite to said one end, a second obliquely-disposed, lip-engageable applicator surface joined to the remainder of the body, said second lip-engageable applicator surface having a textured surface configuration, whereby following application of said substance from said one end to the lips, the tubular body can be reversed and the second applicator surface utilized to polish the lips and thus impart a smoothing effect thereto, and f) said second obliquely-disposed, lip-engageable applicator surface comprising an abrasiveness that is finer than an abrasiveness of said first surface and which is of the quality of pumice and/or fine sandpaper.

2. A cosmetic stick applicator as claimed in claim 1, wherein:

a) the oblique disposition of the first applicator surface is with respect to the axis of the tubular body.

3. A cosmetic stick applicator as claimed in claim 1, wherein:

a) the oblique disposition of the second applicator surface is with respect to the axis of the tubular body.

4. A cosmetic stick applicator as claimed in claim 1, wherein:

a) said manually-engageable means comprises a finger-engageable wheel located in between the said ends of the body, and b) an advance screw mechanism and piston, said screw mechanism being turnable with the wheel, and said piston being advanceable in the chamber of the body in response to said turning of the wheel and screw mechanism.

5. A cosmetic stick applicator as claimed in claim 4, wherein:

a) said tubular body has a window in its wall, providing communication between the outside of the body and the said wheel.

6. A cosmetic stick applicator as claimed in claim 1, wherein:

said orifice is clear thereby permit unobstructed flow of said substance through said orifice.

7. A cosmetic stick applicator as claimed in claim 1, and further including a multiplicity of orifices in said one applicator surface, communicating with said inner chamber.

8. A cosmetic stick applicator as claimed in claim 1, wherein:

said substance comprises a material selected from the group consisting of oil-based and water-based formulations.

9. A cosmetic stick applicator as claimed in claim 8, wherein:

said substance contains abrasive particles, held in suspension.

10. A cosmetic stick applicator as claimed in claim 1, wherein:

said texture of said second oblique surface is formed of a plastic material.

11. A cosmetic stick applicator as claimed in claim 1, wherein:

said substance contains abrasive particles, held in suspension.

12. A cosmetic stick applicator as claimed in claim 1, further comprising a cylindrical closure serving as a cap to cover said second obliquely-disposed lip-engageable applicator surface.

* * * * *